US005355813A

United States Patent [19]

Darnell et al.

[11] Patent Number: 5,355,813

[45] Date of Patent: Oct. 18, 1994

[54] LOAD AND ROLL PALLET

[75] Inventors: James R. Darnell, Tinley Park; Ralph DeFalco, Oak Lawn, both of Ill.

[73] Assignee: C.M.I. Freight Trans Inc., Oak Park, Ill.

[21] Appl. No.: 116,588

[22] Filed: Sep. 7, 1993

[51] Int. Cl.[5] ..... B65D 19/44

[52] U.S. Cl. ..... 108/55.3

[58] Field of Search ..... 108/51.1, 55.3, 55.1; 414/358, 357, 373

[56] References Cited

U.S. PATENT DOCUMENTS

| | | | |
|---|---|---|---|
| 1,742,384 | 1/1930 | Fitzgerald, Jr. | 108/51.1 X |
| 2,246,882 | 6/1941 | Gentry | 414/426 |
| 3,429,536 | 2/1969 | Petry et al. | 108/55.3 X |
| 3,726,424 | 4/1973 | DuPuis et al. | 108/51.1 X |
| 3,753,407 | 8/1973 | Tilseth | 108/55.3 X |
| 4,799,840 | 1/1989 | Van Gomprel et al. | 108/51.1 X |
| 4,834,000 | 5/1989 | Darnell et al. | 108/51.1 |
| 5,170,721 | 12/1992 | Troth et al. | 108/51.1 |

*Primary Examiner*—Jose V. Chen

*Attorney, Agent, or Firm*—Gerald S. Geren

[57] ABSTRACT

There is disclosed herein an improved load-and-roll-style pallet for carrying a coil of sheet material, such as sheet steel. The pallet includes a generally rectangular body having a top and a bottom surface, a front and a back, and a pair of sides. A coil-receiving well or depression is provided in the top surface and extends between the front and back ends for cooperating in restraining the coil. Various fittings, straps and chains are used to further secure the coil to the pallet. Tubular structures on either side of the well that extend between the front and back end and open to the back end define a pair of forklift tine-receiving or lift-receiving pockets that straddle the depression and can be used to lift the pallet. The pallet can be lifted and tilted so that the bottom surface is lifted and the rollers engage the surface on which the pallet is rolled to position.

7 Claims, 3 Drawing Sheets

LOAD AND ROLL PALLET

BACKGROUND OF THE INVENTION

This invention relates to improvements in pallets where the lading is loaded thereon and then the pallet and lading are rolled onto or into a container or lading carrier, and more particularly, to a pallet adapted to carry coiled sheet materials and loaded onto a carrier from a side or the rear.

Pallets for carrying lading are widely used. A load-and-roll pallet which includes rollers for movement is disclosed in U.S. Pat. No. 4,834,000, is elongated, has a generally flat upper surface for carrying lading, and has an elongated center beam, sometimes an I-beam, for cooperation in supporting the lading carrying surface. Thirty-five patent references disclosing various rolling and lading-carrying devices are cited in connection with U.S. Pat. No. 4,838,000.

One type of item that is commonly shipped is a roll or coil of sheet material, such as a coil of sheet steel. Such coils are heavy and present the risk of rolling during shipment. On a pallet such as disclosed in U.S. Pat. No. 4,834,000, the coil would be loaded on the flat lading carrying surface with the coil axis transverse to the carrier, its direction of movement and to the elongated pallet, but generally parallel to the pallet rollers. The coil may be held down and in place by a chain that passes through the center of the coil and by straps over the top of the coil, which are secured to the pallet and tightened in place. When the carrier stops, the tendency of such a coil is to roll forwardly as, for example, toward the cab of a truck where the coil is on a trailer. The coil thus seeks to roll against the restraint of the fastening chain or other restraints.

Some authorities have concluded that this type of system may be insufficient to restrain this type of lading.

It is therefore an object of this invention to provide a pallet which employs the advantages of the load and roll system, and additionally enhances the restraining forces preventing the coil from rolling on the pallet.

These and other objects of this invention will become apparent from the following disclosure and appended claims.

SUMMARY OF THE INVENTION

There is disclosed herein an improved load-and-roll-style pallet which meets the foregoing object, is capable of carrying coiled materials, and provides additional coil restraint. The pallet includes a generally rectangular body having a central depression or well in the pallet's top surface, which extends between the front and the back of the pallet. The body section (on each side of the central depression) defines a forklift tine-receiving pocket so that forklift tines can engage and lift the pallet. Rollers are mounted on the front of the pallet toward which the depression extends. The pallet back is open for receiving the forklift tines. The axis of rotation for the roller(s) is transverse to the coil axis so as to enhance side loading of a flat bed.

Moreover, this pallet is shorter than the elongated load and roll pallets. Thus the pallet herein can be loaded onto a carrier such as a flatbed trailer in the transverse or sideways direction rather than from one end and lengthwise of the container.

This sideways loading assures the transverse positioning of the coil and additional restraint on the coil. Moreover, this sideways loading is particularly useful in connection with open sided flatbed trailers.

Thus a coil can be loaded onto a pallet in the depression thereof and chained down to the pallet. Then a forklift can engage and lift the pallet so that it can be tilted and rolled sideways onto a flatbed trailer with the coil extending sideways across the trailer.

Though loading of a flat bed is discussed herein, loading of an enclosed trailer from the end is suitable, especially since the pallets are sized so that two pallets positioned end to end in an enclosed trailer.

DESCRIPTION OF THE PREFERRED EMBODIMENT

Figure 1:
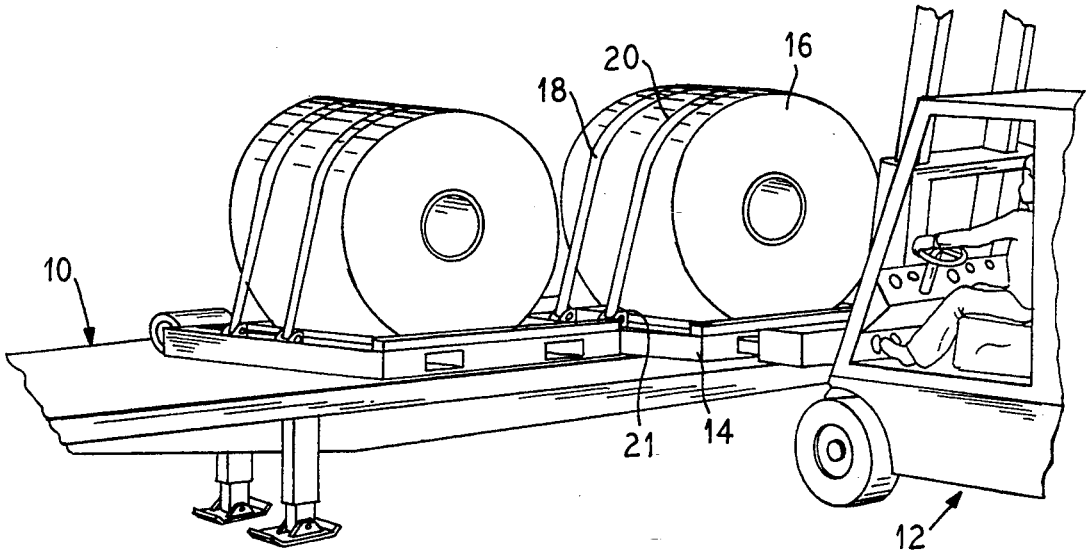
FIG. 1 is a perspective view showing a flatbed trailer with a pallet of this invention carrying a coil being loaded onto the trailer.

Referring first to FIG. 1, there is shown a flatbed trailer 10 onto which a forklift 12 is positioning a pallet 14 which is carrying a coil of sheet steel 16. The coil 16 is "tied-down" to the pallet by various straps and chains such as 18 and 20 that are anchored to fittings 21 on the pallet. The pallet rests on the flatbed trailer.

The pallet 14 includes a top surface 22 and a bottom surface 24. The pallet includes a front end 26 where the rollers are mounted and a back end 28 where forklift pockets open and are positioned between the sides 30 and 32. The body 14 includes a central depression or well 34, generally, which is made of a bottom panel 36 and a pair of upwardly and outwardly sloping walls 38 and 40 which join to the top surfaces 42 and 44. It is noted that the central depression is closed at each end by the front panel 26 and panel back 28.

Two rollers 46 and 48 are mounted on brackets 50, 52, 54 and 56 so as to extend forwardly of the front end with the axis of rotation forwardly of the front. The brackets and rollers are positioned on the front end so that when the back end 28 is lifted and the pallet 14 tipped, the pallet will roll on the rollers 46 and 48. Moreover, when the pallet is positioned and set on the container floor, the pallet is securely positioned and prevented from rolling.

Figure 3:
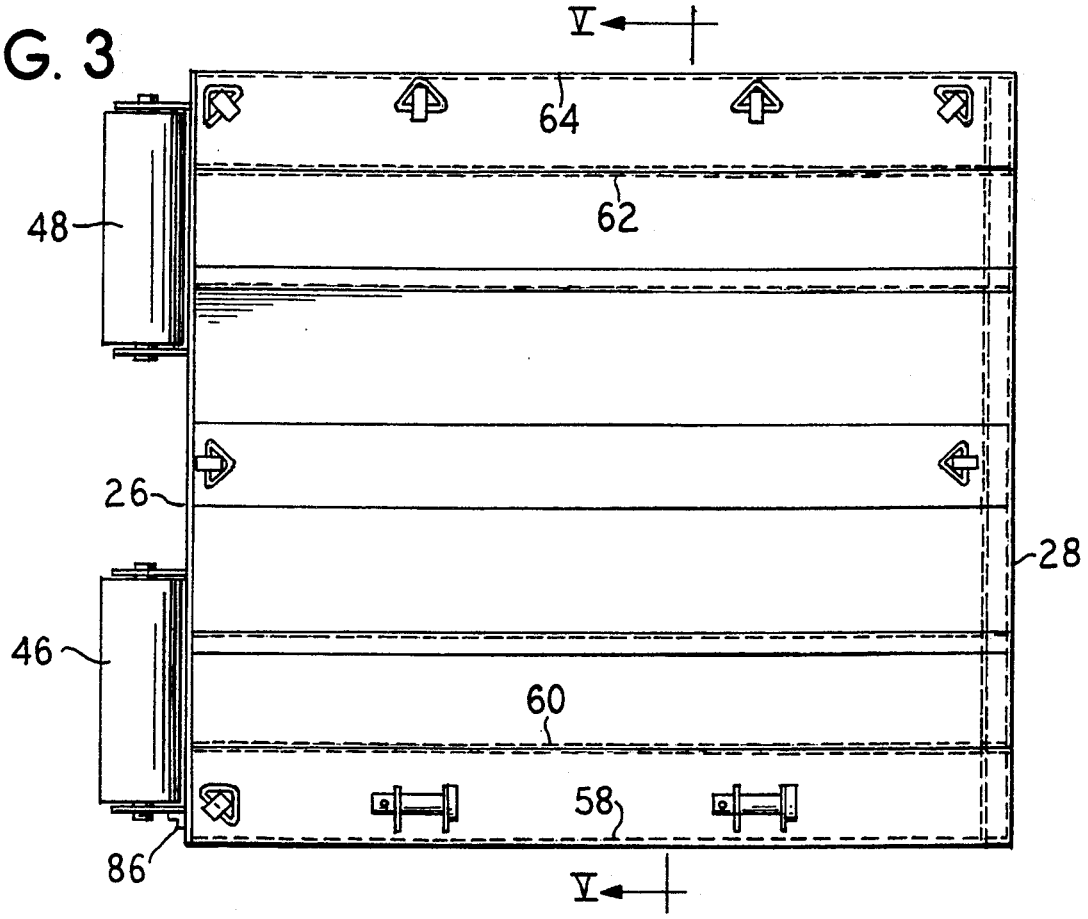
FIG. 3 is a top plan view of the pallet showing the depression.
Figure 4:
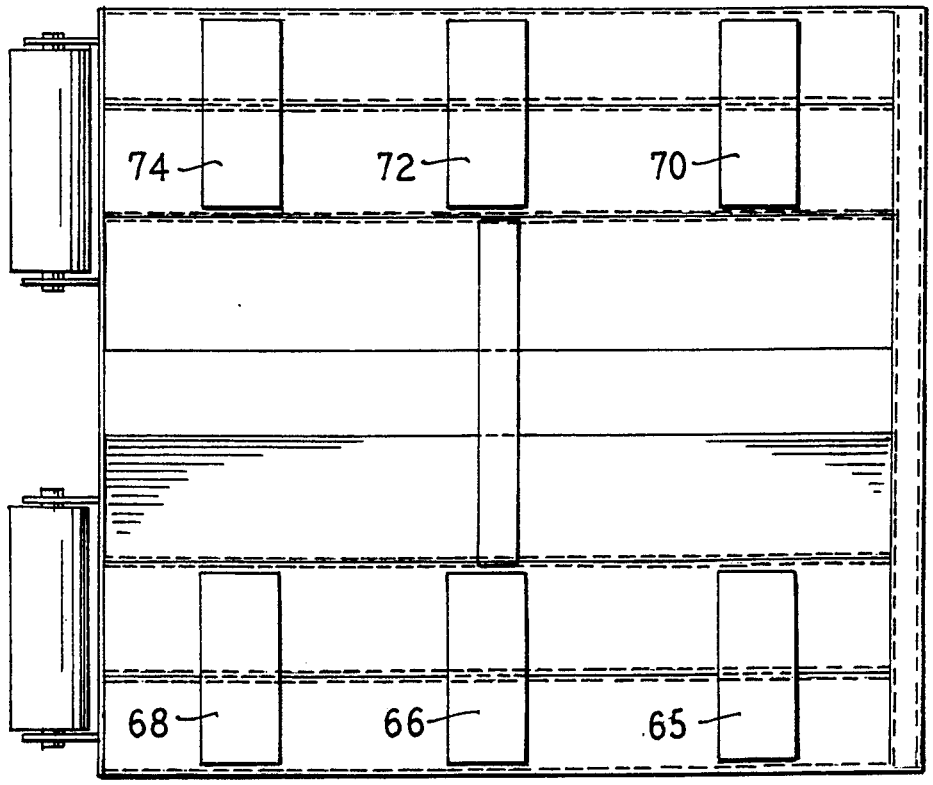
FIG. 4 is a bottom view of the pallet.

The top surface of the pallet is shown in FIG. 3. In that figure the dashed lines 58, 60, 62, and 64 indicate internal walls formed by internal tubes that form the forklift tine receiving or lift pockets. The pockets open at the back or are accessible so as to permit access of the forklift tines to the tine pockets.

The bottom surface 24 of the pallet is shown and may be flat with an anti-skid surface. Six rubber pads 65, 66, 68, 70, 72 and 74 are shown affixed to the bottom and extend between the back and front of the pallet on either side of the center depression. These pads are to minimize pallet slippage.

Figure 5:
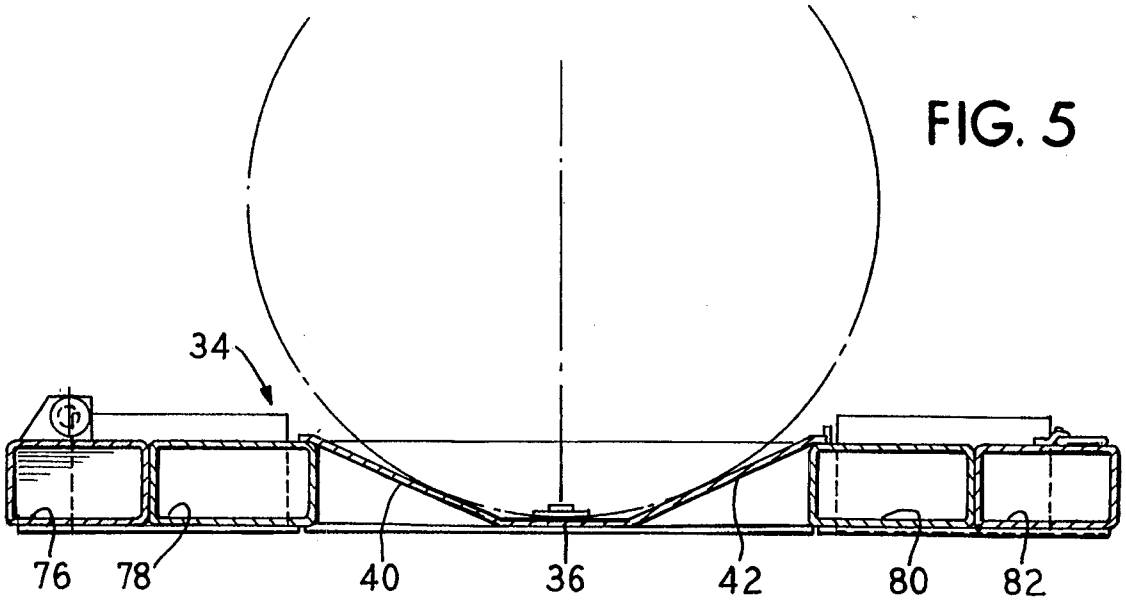
FIG. 5 is a sectional view along line V—V of FIG. 3 showing the internal construction for the pallet.

The tubes 76, 78, 80 and 82 are best seen in FIG. 5 and the center depression 34 and plates 36, 38 and 40 are shown. Dimensionally the depression is 36.25 inches across, the bottom plate 36 is 8.75 inches wide, and the side angle plates are 14 inches across. The inner tubes 78 and 80 are $6\times12\times\frac{1}{4}$ inch tubing. The outer tubes 76 and 82 are $6\times10\times\frac{1}{4}$ inches.

Figure 6:
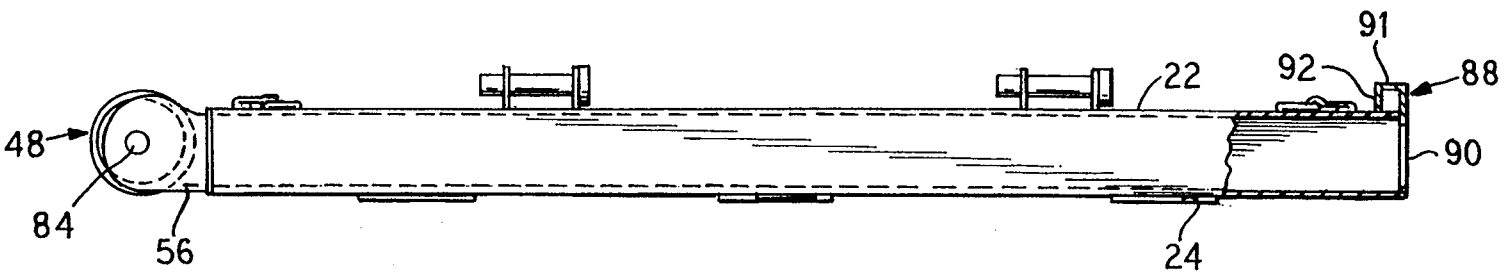
FIG. 6 is a vertical view showing the roller mounted to the front of the pallet.

The rollers 46 and 48 are mounted to the front end of the pallet so that the bottom of the rollers are spaced slightly above the vehicle floor or the bottom surface 24 of the pallet. Referring to FIG. 6, one of the rollers 48 and its mounting is shown. Each roller is fabricated from 8-inch diameter pipe that is 24 inches long and appropriate roller ends, sleeves and bushings are secured at each end so as to provide a pin-like connection such as 84 to the mounting plate 56 so that the roller can rotate.

The pallet body between the upper and lower surfaces is about 6 inches thick. When the back end of the pallet is raised, usually more than six inches, the bottom surface 24 disengages the support surface, the roller is in contact with the container or trailer floor and the pallet can be rolled. In the opposite direction, when the back end of the pallet is lowered, the pallet's bottom surface 24 engages and is flush with the container or trailer floor. It is noted that the roller's top surface extends above the pallet's top surface.

The mounting brackets such as 52 are mounted to the front end of the pallet by an angle iron such as 86 which has one leg welded to the pallet front 26 and the other leg welded to the bracket such as 52. Thus using the angle iron, a firm connection is made between the pallet body and the roller.

The back of the pallet is fitted with an inverted J-shaped plate 88 wherein the long leg 90 of the J is secured to the rear surface of the pallet and extends above the top upper surface. The J member includes a bight section 91 that extends inwardly and a return leg 92 that extends downwardly to the pallet's top surface 22.

Figure 2:
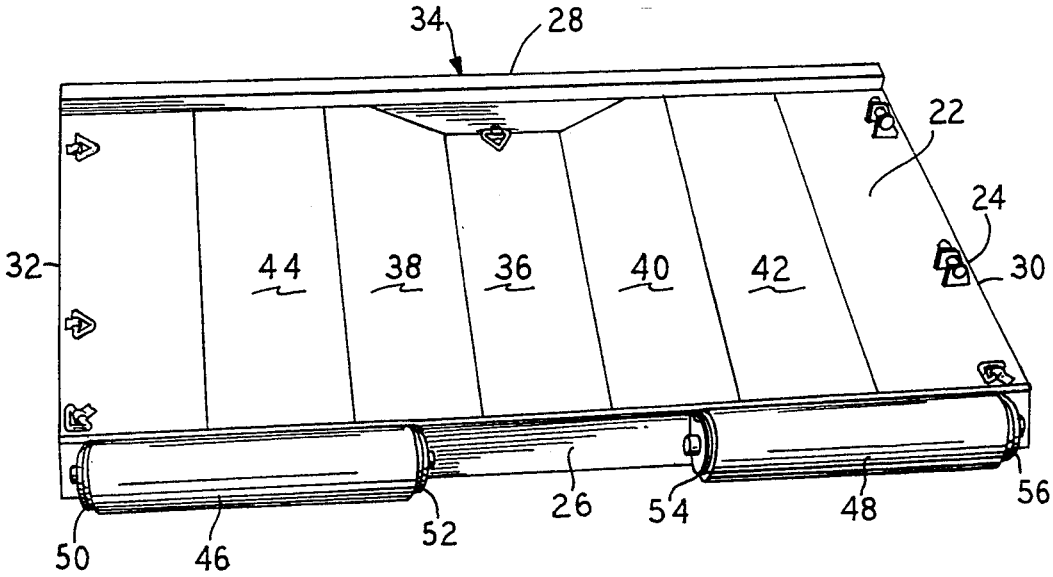
FIG. 2 is a perspective view of the pallet of this invention showing the central depression and rollers.

As seen from the drawing, particularly FIG. 2, the front and back surfaces or walls 26 and 28 at the end of the central depression provide some restraint in the event lading in the depression shifts toward the front or back of the pallet.

In operation, a pallet such as 14 is positioned on the ground such as a loading dock surface. A coil of sheet material, probably steel such as 16, is placed on the pallet in the central depression with the coil axis generally parallel to the depression, or with the coil ends facing the front and back of the pallet. A foam pad can be used between the coil and pallet if desired so as to minimize surface moving. The coil is then tied down to the pallet so as to minimize coil movement relative to the pallet and maximize stability. Tie down is by chains and strapping.

A forklift then extends lifting tines into the lifting pockets from the pallet back and then lifts the pallet and coil for positioning on a lading carrier, like a flatbed truck. The pallet tilts and then can be rolled onto the trailer bed, either lengthwise of the trailer if enclosed or crosswise (i.e., from side to side) in the case of a flat bed. Usually the pallet will be loaded across a flatbed trailer from side-to-side so that the coil axis and depression longitudinal axis are transverse to the direction of movement of the lading container and transverse to the axis of rotation of the roller. Then the pallet is lowered so as to rest on the trailer bed. At rest the rollers are spaced above the floor and not in engagement therewith. As indicated above, the pallets can be used to load a trailer from the end.

Although the invention has been described with respect to a preferred embodiment, changes and modifications can be made which are within the spirit and scope of the invention.

We claim as our invention:

1. An improved load-and-roll-style pallet which includes:

a generally rectangular body for carrying lading, for positioning on a floor of a lading carrier, and for movement with the carrier;

said body having top and bottom surfaces, a front end, a back end and a pair of sides;

said body defining an elongated central lading carrying depression which extends between the front end and the back end, is positioned between the sides and, has a pair of opposite ends;

a roller systems mounted to the body (a) at the front end, (b) extending forwardly thereof, (c) whose axis of rotation is generally transverse to the lading carrying depression and, (d) whose axis of rotation is forward of the front end;

said body defining a pair of lift pockets, one member of the pair between the depression and each side, wherein each pocket opens to the back so the pallet can be lifted, rolled in position on a lading carrier, and said front end and back end each including an end plate that extends across an end of the central depression and both plates closing the ends of the central depression so as to enhance the front-end to back-end restraint to the shifting of lading loaded in the central depression.

2. An improved pallet as in claim 1, wherein said roller system includes a roller positioned above the pallet bottom surface so as to be spaced above a supporting floor when said bottom surface engages said floor.

3. An improved pallet as in claim 2, wherein said roller extends above the top surface of the pallet.

4. An improved pallet as in claim 1, wherein said roller system includes a pair of rollers mounted to said front, each spaced above the pallet bottom surface.

5. An improved pallet as in claim 1, wherein the pallet body includes a pair of tine-receiving tubes, one on either side of the depression, between the depression and a side, and which extend from the back end toward the front end and are spaced apart in distance to receive the tine of a fork-lift for lifting the pallet.

6. An improved pallet as in claim 1, wherein there is further provided a plurality of hold down fittings, each secured to the pallet body for cooperating in securing lading.

7. An improved load-and-roll-style pallet which includes:

a generally rectangular body for carrying lading, for positioning on a floor of a lading carrier, and for movement with the carrier;

said body having top and bottom surfaces, a front end, a back end and a pair of sides;

said body defining an elongated central lading carrying depression which extends between the front end and the back end, is positioned between the sides thereof, and has a pair of opposite ends;

a roller system mounted to the body (a) at the front end, (b) extending forwardly thereof, (c) whose axis of rotation is generally transverse to the lading carrying depression, and (d) whose axis of rotation is forward of the front-end;

said body defining a pair of lift pockets, one member of the pair between the depression and each side, wherein each pocket opens to the back so that the pallet can be lifted, rolled and position on a lading carrying carrier;

a bottom plate associated with the bottom surface and a pair of upwardly sloping side plates extending from the bottom surface to the top surface and secured to the bottom plate which together form the central depression;

four elongated tubular members, two positioned on each side of the central depression and abutting each other in side-to-side relation, one of said tubes secured to the sloping side plate and the other of said tubes forming a side surface;

two of said tubes cooperating with said pockets, in defining the lift pockets, one on each side of the central depression and spaced apart a distance to receive the tines of the fork-lift truck, and wherein said front and back ends each include an end plate that extends across an end of the central depression and both plates closing the ends of the central depression so as to enhance front end to back end restraint to the shifting of lading loaded in the central depression.

* * * * *